US006662542B2

(12) United States Patent
Stephan et al.

(10) Patent No.: US 6,662,542 B2
(45) Date of Patent: Dec. 16, 2003

(54) OPEN-END SPINNING DEVICE AND PROCESS FOR TEMPORARY RECEIVING A YARN

(75) Inventors: Adalbert Stephan, Beilngries/Paulushofen (DE); Harald Widner, Ingolstadt (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 83 days.

(21) Appl. No.: 09/935,115

(22) Filed: Aug. 22, 2001

(65) Prior Publication Data

US 2002/0023422 A1 Feb. 28, 2002

(30) Foreign Application Priority Data

Aug. 25, 2000 (DE) ..... 100 41 973

(51) Int. Cl.[7] ..... B65H 69/06

(52) U.S. Cl. ..... 57/263; 57/22; 57/400; 57/404

(58) Field of Search ..... 57/22, 261–263, 57/400, 404–417; 242/473.6, 473.7, 473.8, 475.1, 475.2, 475.6, 476, 476.4, 476.6; 28/292–294; 19/159 R, 159 A, 65 A; 289/2–16

(56) References Cited

U.S. PATENT DOCUMENTS 5,331,798 A * 7/1994 Ball et al. ..... 57/263
5,535,580 A * 7/1996 Sebastian et al. ..... 57/263
5,927,061 A 7/1999 Greis
6,035,622 A * 3/2000 Fox et al. ..... 57/263

FOREIGN PATENT DOCUMENTS

DE 3336865 A1 4/1984
DE 4422524 A1 1/1996

OTHER PUBLICATIONS

German Search Report dated Jan. 16, 2001.
English language Abstract for DE 33 36 685 A1.
English language Abstract for DE 44 22 524 A1.

* cited by examiner

*Primary Examiner*—John J. Calvert
*Assistant Examiner*—Shaun R Hurley
(74) *Attorney, Agent, or Firm*—Dority & Manning

(57) ABSTRACT

In open-end spinning and in coordination with predetermined operating phases, a yarn suction pipe by means of which a yarn extending from a bobbin is to be received temporarily is brought successively into different operating planes. The yarn suction pipe is imparted a defined operational movement as a function of the operating planes occupied and in coordination with the current operating phase. The operating positions of the yarn suction pipe that can be moved into at least two operating planes are defined in such a manner that when the yarn suction pipe is in its operating position in a first operating plane, a yarn extending from the bobbin pressing on a winding roller to the yarn suction pipe crosses the traversing range of the yarn traversing guide. However, the yarn is outside the traversing range of this yarn traversing guide when the yarn suction pipe assumes its operating position in an additional operating plane. The yarn suction pipe is mounted on a swivel pin that is in turn mounted on an additional swivel pin.

19 Claims, 3 Drawing Sheets

OPEN-END SPINNING DEVICE AND PROCESS FOR TEMPORARY RECEIVING A YARN

BACKGROUND OF THE INVENTION

The present invention relates to an open-end spinning device as well as to a process for the temporary receiving of a yarn by means of such a device.

With open-end spinning devices, it is normal practice to have a service unit patrolling alongside a plurality of identical open-end spinning devices so as to be able to perform maintenance tasks at each one of these open-end spinning machines when necessary. For this purpose, the service unit is, as a rule, provided among other things with a yarn suction pipe that can be brought from a resting position within the contours of the service unit into a working position in which it is located in close proximity of the yarn path (DE 196 34 300 A1). This yarn suction pipe has, e.g., the task of preparing a length of yarn for the piecing return feeding and of temporarily storing yarn excess produced during piecing, until it is used up due to the difference in speeds between a device drawing the pieced yarn from the spinning element and the bobbin.

OBJECTS AND SUMMARY OF THE INVENTION

It is a principal object of the present invention to further develop the known suction device and to create a process for the temporary receiving of a yarn by means of such a device, so that it becomes possible for the device to handle additional tasks. Additional objects and advantages of the invention will be set forth in part in the following description or may be obvious from the description, or may be learned through practice of the invention.

This object is attained through the invention by having the yarn suction pipe movable within at least one additional operating plane. Due to the fact that the yarn suction pipe can be moved not only within one single operating plane but can be brought out of it and into at least one additional operating plane and can be moved within that plane, the yarn suction pipe is capable of carrying out tasks in a further operating plane offset in time relative to tasks to be carried out in a first operating plane.

Preferably, the operating planes, of which at least two are provided, of the yarn suction pipe are placed at an angle relative to each other so that they form an angle between them. By "angle," an angle value is understood as being greater than zero and smaller than infinite.

In a further development according to the invention, the resting position of the yarn suction pipe is provided in proximity of the interface of two operating planes of the yarn suction pipe and/or is provided only in one single operating plane. This results in space-saving advantages.

Preferably, the operating positions are established in two operating planes that take into account the traversing range of the yarn traversing guide. This makes possible a soft transfer of the yarn to a traversing guide in one operating plane when the full bobbin is set on the winding roller, while in the other operating plane the yarn extending from the yarn guide to the bobbin driven by the winding roller is not within the traversing range of the traversing guide.

In a further development according to the invention of the open-end spinning device, the yarn suction pipe can be controlled by a control device in accordance with a previously prepared program, so that it is taken into one of the operating planes provided to carry out the operating movements for that operating plane.

For various tasks to be carried out by the yarn suction pipe, it suffices if it can merely be taken from its rest position into one single operating position. However, in order for the yarn suction pipe to be able to handle more complex tasks, it is an advantage if the yarn suction pipe is also able to assume several operating positions, one after the other, in at least one of its operating planes.

In the interest of a simple design, the yarn suction pipe can be mounted on a swivel pin so that it can be swiveled.

The movement of the yarn suction pipe from one operating plane to another operating plane can be effected in various ways, e.g., by moving it along a guiding system. In a preferred embodiment of the device according to the invention, it is possible to provide for the yarn suction pipe to be movable along its swivel pin or around an additional swivel pin supporting the swivel pin of the yarn suction pipe into an additional operating plane. It may be advantageous to install this additional swivel pin essentially parallel to the axis of the winding roller.

The apparatus described above makes it possible to carry out a process according to the invention in adaptation to different operating phases of the operating process. The yarn suction pipe is brought into the corresponding operating plane in a sequentially synchronized manner, in which it then carries out its operating movements provided for this operating plane and this operating phase. In this manner, the yarn suction pipe can carry out operating movements different from the ones carried out at other locations, and can thus carry out completely different tasks.

In another variant of the process, the yarn suction pipe is brought into the same operating plane to receive the yarn drawn off from a bobbin, independent of the operating plane to be occupied for the execution of certain operational movements.

According to a further embodiment of the invention, the yarn suction pipe can execute the operating movements required for the formation of a piecing reserve or the temporary storing of a yarn surplus occurring briefly during piecing in the same plane in which it had previously taken up the yarn presented to it. In order to constitute a yarn end reserve on the full bobbin, the yarn suction pipe can be transferred from the operating plane in which it had previously taken up the yarn drawn off from a bobbin into another operating plane in which it imparts its operational movements.

The device as well as the process according to the present invention makes it easily possible for one and the same yarn suction pipe to carry out entirely different tasks at different times. At the same time, the design of the device is simple and space-saving, since, instead of a plurality of yarn suction pipes with the appertaining terminals and their controls, only one single such yarn suction pipe is required for a number of different tasks.

Examples of embodiments of the invention are explained below through drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

Figure 1:
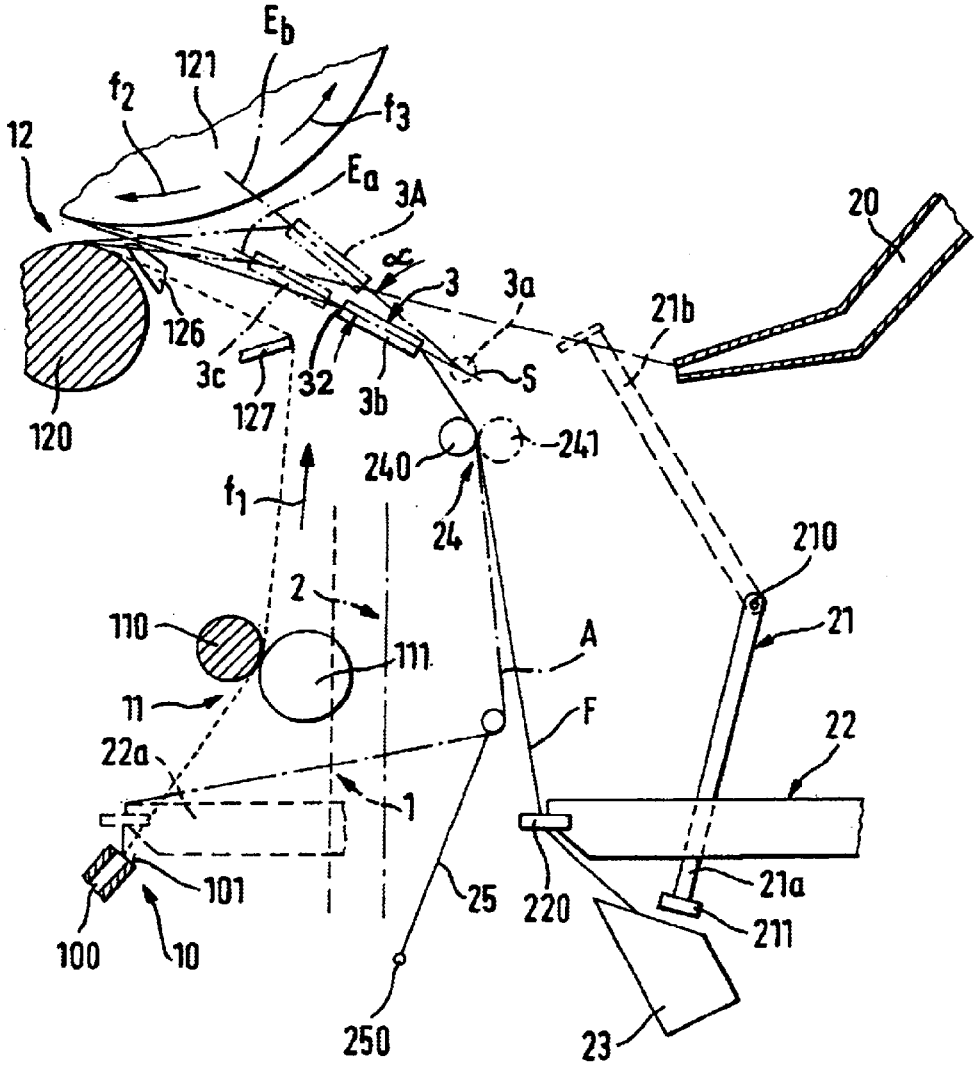
FIG. 1 shows a schematic lateral view of a device according to the invention with a yarn suction pipe that can be placed at will in one of two operating planes.

FIG. 1 schematically shows an open-end spinning machine 1 indicated by a broken line on the left side of the drawing, while a service unit 2 is indicated on the right side of the drawing by means of a dot-dash line. The service unit 2 is able to patrol in a known manner alongside the open-end spinning machine 1, which has a plurality of identical open-end spinning devices 10. Of the open-end spinning machine 1 as well as of the service unit 2, only those elements that are necessary to understand the invention are shown in the FIGS. 1 to 4. For this reason, only a known yarn suction pipe 100 of an open-end spinning device 10 of this type is shown in FIG. 1.

The open-end spinning machine 1 is furthermore equipped with a yarn draw-off device 11 with a draw-off shaft 110 which extends over a plurality of identical, adjoining open-end spinning devices 10. During the drawing off of a yarn F from the open-end spinning devices 10, a pressure roller 111 presses against this draw-off shaft 110 and can be lifted off from the draw-off shaft 110 when necessary.

The yarn F drawn off by the yarn draw-off device 11 from the open-end spinning devices 10 is conveyed to a winding device 12 equipped with a winding roller 120 that also extends over a plurality of adjoining open-end spinning devices 10. A bobbin 121 lies on the winding roller 120 during the spinning process in order to wind up the yarn F produced in the open-end spinning device 10. The bobbin 121 is held in a known manner between two bobbin arms 122 and 123 (see FIG. 2) by means of rotatably mounted bobbin plates (not shown), whereby the bobbin arm 122 has a lifting arm 124.

During the spinning process, the yarn F is traversed by a yarn traversing guide 126 located before the bobbin 121 as seen in the direction of yarn movement (see arrow $f_1$), so that the yarn F is laid down evenly over the length of the bobbin 121 (bobbin body) during winding. To ensure nearly constant yarn tension of the yarn F during this operation, a yarn tension equalization hoop 127 is installed within the course of the yarn before the yarn-traversing guide 126 in the direction of draw-off (see arrow f1).

A swiveling suction pipe 20 is located on the service unit 2 and can be swiveled from the shown resting position until it is in proximity of the bobbin 121.

In addition, a presentation device 21 is installed on the service unit 2 that can be brought from a lower end position 21*a* indicated by a full line into an upper end position 21*b* by swiveling around a swivel pin 210. This presentation device 21 has a swiveling yarn catcher 211 at its free end.

In proximity of the swiveling range of the yarn catcher 211 is a controllable clamping device 220 which is part of a yarn feeder 22. This yarn feeder 22 can be brought from a starting position indicated by a full line into a second position 22*a* above the outlet opening 101 of the yarn draw-off pipe 100.

In the area of the lower end position of the presentation device 21, a yarn end preparation device 23 exists.

The service unit 2 is further equipped with an auxiliary roller pair 24 with a stationary roller 240 and a driven roller 241 which can be presented to the roller 240.

In addition, a reserve hoop 25 by means of which a piecing reserve A can be constituted and which swivels around a swivel pin 250 is located on the service unit 2.

In addition, a yarn suction pipe 3 of which FIG. 1 only shows the area with its outlet 32 is provided on the service unit 2. This yarn suction pipe 3 is mounted on a pin 40 so as to be able to swivel (see FIG. 3) and can execute operating movements as desired within a first plane $E_a$ or a second operating plane $E_b$ or can be moved into different operating positions 3*b*, 3*c* or positions 3A, 3B, 3C (see FIG. 2). The yarn suction device 3 is connected to a hose 31 that is in turn connected to a negative-pressure source in a controllable manner not shown here.

Figure 2:
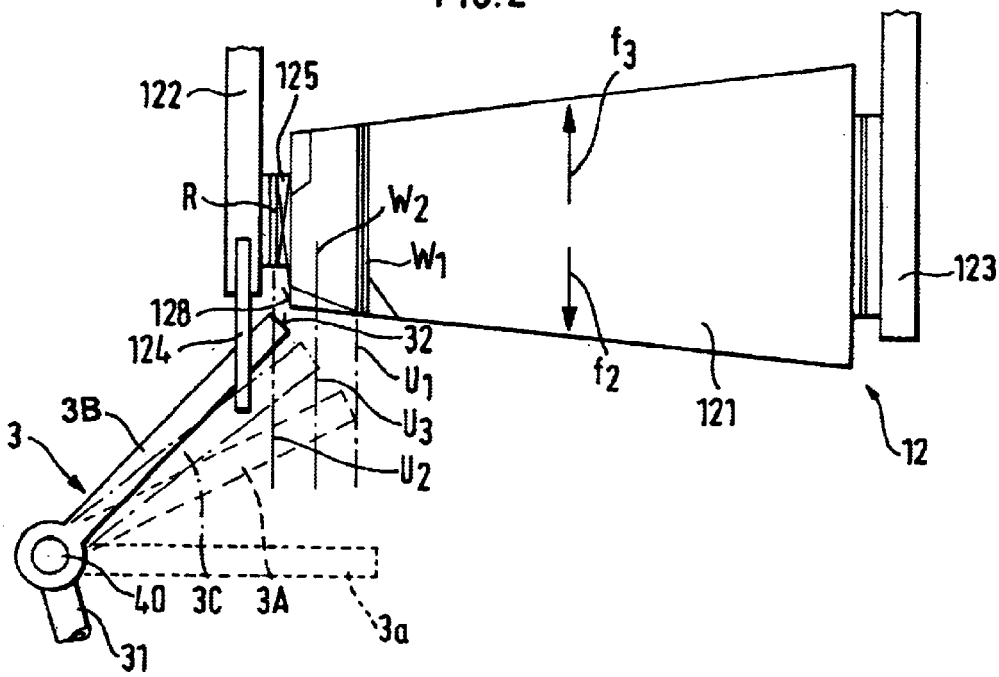
FIG. 2 shows a top view of a bobbin and of a yarn suction pipe interacting with it.

As a comparison between FIGS. 1 and 2 shows, it is not important whether a cylindrical or conical bobbin 121 is being formed. The described device and also the described process can be applied independently of the shape of the bobbin 121 being formed.

The structure of the device was described above, and now its operation during piecing following stoppage of the open-end spinning device 10 shall be described with the help of FIG. 1. For example a yarn breakage has occurred, and the bobbin 121 has therefore been lifted from the winding roller 120 by raising the lifting arm 124 (FIG. 2) and has thus been stopped.

In order to resume the spinning process, a piecing process must be carried out. For this, the suction pipe 20 is first swiveled from its resting position shown in FIG. 1 towards the bobbin 121. Furthermore, an auxiliary drive roller (not shown) is brought to bear on the bobbin 121, by means of which the bobbin 121 is driven in unwinding direction (arrow $f_3$). Because of the negative pressure prevailing in the suction pipe 20, this suction pipe 20 takes up the yarn end located on the bobbin 121 and sucks it up to the extent that it becomes available through the reverse rotation of the bobbin 121. As soon as the suction pipe 20 has taken up a long enough yarn segment to ensure secure holding of the yarn F, the suction pipe 20 is swiveled back into its starting position while the bobbin 121 is at first still driven in unwinding direction (see arrow $f_3$), so that the suction pipe 20 continues to take up the length of yarn released by the bobbin 121 until the bobbin 121 is stopped by the (not shown) auxiliary drive roller.

The yarn suction pipe 3 that has been until then in its resting position 3*a* in a first operating plane $E_a$ (see FIGS. 1 and 2) is brought within this first operating plane $E_a$ with its outlet 32 into the operating position 3*b* shown in FIG. 1 by swiveling it around its pin 40. In this position, the yarn F passes the zone of the outlet 32 of this yarn suction pipe 3 during the further operating phases, as shall be explained further below.

By means of the (not shown) auxiliary drive roller, the bobbin 121 is driven in winding direction (arrow $f_2$) for a short time. Since the bobbin 121 is in lifted position and the yarn F connected to the bobbin 121 extends to the suction pipe 20, the path of the yarn does not cross the movement range of the yarn traversing guide 126. Thereby, parallel windings are produced on the bobbin 121, and these are located at a defined location relative to the longitudinal extension of the bobbin 121 due to a corresponding (not shown) configuration of the outlet of the suction pipe 20. A defined yarn path results in this case between the bobbin 121 and the suction pipe 20.

At the latest at that point in time, the presentation device 21 is swiveled around its swivel pin 210 from its lower end position 21*a* into its upper end position 21*b*, whereby the swiveling path of the presentation device 21 is located outside the path of yarn F extending from the bobbin 121 to the suction pipe 20. When the presentation device 21 is in its upper end position 21*b*, the yarn catcher 211 located at the free end of the presentation device 21 is actuated and is moved into such a position that it seizes and takes along the yarn F during the following downward swiveling motion of the presentation device 21. This yarn F forms a loop (not shown) between the bobbin 121 and the suction pipe 20. The length of yarn necessary for the formation of the loop is withdrawn from the suction pipe 20 in this process.

As the presentation device 21 is swiveled down into its lower end position 21*a*, the yarn F reaches the nip of the clamping arrangement 220 of the yarn presenter 22, where it is fixed by clamping. At its leading end relative to the down-swiveling movement, the presentation device 21 is supporting a yarn cutting device (not shown) that is now actuated. The yarn segment freed thereby and extending to the suction pipe 20 is removed through the suction pipe 20.

The presentation device 21 continues its down-swiveling movement and takes the yarn end produced by cutting into the zone of influence of the yarn end preparation device 23 where it releases the yarn end. The yarn end is now held by the yarn end preparation device 23 that puts the yarn end in a known manner into a state that is suitable for the piecing process to be carried out.

The bobbin 121 is now driven by means of the (not shown) auxiliary drive roller in unwinding direction (arrow $f_3$), whereby the yarn length freed from the bobbin 121 is taken up by the yarn suction pipe 3 which had already been brought into the path of the yarn as described earlier. When the yarn segment stored in the yarn suction pipe 3 has reached a predetermined length, a piecing reserve A is constituted by swiveling the reserve hoop 25 into yarn F. The length of yarn required for this is taken from the yarn suction pipe 3.

The yarn presenter 22 is then taken out of its starting position indicated by a full line into its position 22*a* in which the free yarn end is within the area of influence of the air stream entering the outlet opening 101 of the yarn draw-off pipe 100. This air stream is produced in a known manner inside the open-end spinning device. The yarn suction pipe 3 brought into the path of the yarn compensates for differences in yarn length that occur in this case.

During the movement of the yarn presenter 22 into its position 22*a*, the yarn F comes into contact with the roller 240 of the auxiliary roller pair 24. The second roller 241 is now applied on the roller 240 so that the yarn F is in the nip of this auxiliary roller pair 24.

The release of the lifting arm 124 causes the bobbin 121 to be lowered so that it is again applied to the winding roller 120. The bobbin 121 is again driven in the winding direction (arrow $f_2$) by the winding roller 120, thus winding up the yarn F from the yarn suction pipe 3. The driving of the bobbin 121 can at first be assisted also by the (not shown) auxiliary drive roller that continues to be applied to the bobbin 121.

Before the lowering of the bobbin 121 on the winding roller 120, the yarn F extending from the bobbin 121 to the yarn suction pipe 3 is located above the yarn tension equalization hoop 127 and outside the movement range of the yarn-traversing guide 126. However, the lowering of the bobbin 121 causes the yarn F to enter this movement range and the path of the yarn-traversing guide 126. The latter thus receives the yarn F and forms windings crossing each other on the bobbin 121 as the yarn is wound up on it. At this point in time, the yarn F is not yet within range of the yarn tension equalization hoop 127, nor is this necessary, since the bobbin 121 is able to draw off the yarn length needed for winding from the yarn suction pipe 3 without change of the yarn tension of the yarn F.

The yarn length temporarily stored in the yarn suction pipe 3 is monitored by a yarn monitor (not shown). The reserve hoop 25 is actuated as a function of the yarn length inside the yarn suction pipe 3 and thereupon releases the piecing reserve A. This actuation can be effected by swiveling the reserve hoop 25 or by throwing off from the same in a known manner.

The released yarn F comes into contact with fibers that are fed to a known spinning element of the open-end spinning device 10, so that the spinning process can be started by renewed withdrawal of the yarn F from the open-end spinning device 10. The auxiliary roller pair 24 now driven in draw-off direction withdraws the yarn.

When the piecing reserve A is released, the yarn F is applied to the draw-off shaft 110. The pressure roller 111 is now placed on the draw-off shaft 110 so that the yarn draw-off device 11 on the machine draws off the yarn F from the open-end spinning device 10 from then on. The auxiliary roller pair 24 is now no longer needed. For this reason, the driven roller 241 is lifted off from the other roller 240 of the auxiliary roller pair 24.

Because of the large mass of the yarn F wound up on it, the bobbin 121 cannot be accelerated as rapidly as the pressure roller 111 placed on the draw-off shaft 110. Therefore, a yarn surplus is created between the yarn draw-off device 11 and the bobbin 121 and is taken up by the yarn suction pipe 3.

At the right moment the roller 240 also releases the yarn F in a known manner, whereby the yarn surplus created by a shortening of the path caused by the release of the yarn is also taken up by the yarn suction pipe 3.

The yarn suction pipe 3 is then moved from its operating position 3*b* into its operating position 3*c* (FIG. 1). This reduces the magnitude of the yarn deflection. When the yarn F temporarily stored in the yarn suction pipe 3 is used up in spite of the continuous feeding of the yarn F by the yarn draw-off device 11, the yarn path is shortened again since the yarn F is now applied against the yarn tension equalization hoop 127.

It is possible to dispense in certain cases with an additional operating position 3*c* when the operating position 3*b* of the yarn suction pipe 3 is properly defined for the reception of a yarn surplus. In such cases, a somewhat greater drop in tension, causing a certain disturbance in the bobbin build-up must be accepted briefly for the transfer of the yarn F to the yarn tension equalization hoop 127 as the yarn surplus stored in the yarn suction pipe 3 is used up as a result of the shortening of the yarn path. For this reason, more than just one single operating position 3*b* (see operating position 3*c*) of the yarn suction pipe 3 is provided with the above-described embodiment.

The yarn suction pipe 3 has taken up the yarn F in the operating plane $E_a$, readied the yarn F so that the reserve hoop 25 could constitute a piecing reserve A, and temporarily stored the yarn surplus produced momentarily during piecing. When this temporarily stored yarn surplus has been used up, the yarn suction pipe 3 has accomplished its task pertaining to the piecing process. It is returned then into its resting position 3a without having left the operating plane $E_a$ during piecing.

Once all the elements and aggregates of the service unit 2 have again returned to their resting positions within the contours of the service unit 2, the service unit 2 leaves the open-end spinning device 10 upon successful piecing in order to work at another open-end spinning device 10 now requiring service.

The service unit 2 is not only able to carry out a piecing process, but it can also replace bobbins or perform other maintenance tasks, e.g., cleaning, etc.

As an example of an additional service task in which the yarn suction pipe. 3 is used, the forming of a yarn end reserve R is described below. Such a yarn end reserve R is to be generated on a full bobbin 121 before doffing of the bobbin (see tube 125).

The operational steps up to the reception of the yarn F by the yarn suction pipe 3 are the same as described previously in connection with piecing. Here too, the yarn suction pipe 3 takes up the yarn F for as long as the yarn suction pipe 3 is in its first operating plane $E_a$, even if subsequent operational steps are carried out in a second operating plane $E_b$.

When the yarn end which has been cut by means of the cutting device assigned to the presentation device 21 is located in the yarn suction pipe 3, the auxiliary drive roller drives the bobbin 121 in the unwinding direction (see arrow $f_3$) causing a sufficient yarn length to be delivered into the yarn suction pipe 3 for the operational steps described below, whereupon the bobbin 121 is stopped. The yarn-suction pipe 3 is then moved from its operating plane $E_a$ into another operating plane $E_b$. The manner in which this movement is accomplished is explained further below.

To avoid the necessity of reserving a large area for the space to be traversed by the yarn suction pipe 3 during this movement of the yarn suction pipe 3 from the first operating plane $E_a$ into the second operating plane $E_b$, the resting position 3*a* is provided in the closest possible proximity of the interface S between the two operating planes $E_a$ and $E_b$.

When it has reached the operating plane $E_b$, the yarn suction pipe 3 is brought into a first operating position 3A before an end of the stopped bobbin 121. The latter is now again driven in wind-up direction (see arrow $f_2$) by being brought into contact with the winding roller 120. The yarn suction pipe 3 which is in operating plane $E_b$ assumes such a position in its operating position 3A that the yarn F extending from the yarn suction pipe 3 to the bobbin enters neither the movement range of the yarn traversing guide 126 nor the area of the yarn tension equalization hoop 127 even though the bobbin 121 is pressing on the winding roller 120. Thus, parallel windings $W_1$ are formed in wind-up direction (see arrow $f_2$) on a circumferential area $U_1$ of the bobbin body while the bobbin 121 is driven, whereby two or three such windings $W_1$ suffice. The yarn suction pipe 3 is then moved beyond the adjoining edge 128 of the bobbin 121 to its operating position 3B, while the bobbin 121 continues to be driven in wind-up direction. The circumferential area $U_2$ on which the yarn F is now wound to produce a yarn end reserve R consisting of one or several windings is no longer within the longitudinal area of the bobbin 121 but outside of same, in the area of tube 125. Once the desired number of windings of the yarn end reserve R has been formed here, the yarn suction pipe 3 is brought into operating position 3C in the circumferential area $U_3$ of the bobbin 121, where one or more parallel windings $W_2$ are again produced.

As the description above shows, the yarn suction pipe 3 can be brought into more than only one single operating position 3A, 3B or 3C also in operating plane $E_b$. Furthermore, the windings $W_2$ can in some cases also cover the windings $W_1$, even though FIG. 2 shows two windings $W_1$ and $W_2$ at two different locations of the bobbin 121. This is achieved in that the operating positions 3A and 3C are selected so that they coincide.

In synchronization with the formation of the yarn end reserve R, the yarn F extending towards the yarn suction pipe 3 is cut in a suitable manner (not shown). The yarn suction pipe 3 is equipped for instance with a cutting device at its outlet or in proximity thereof, which is able to carry out this task. Furthermore, the bobbin 121 is stopped by lifting off the winding roller 120 upon formation of the yarn end reserve and the return of the yarn F on the bobbin body. The full bobbin 121 can now be replaced by an empty tube 125.

The yarn suction pipe 3 has carried out its task and returns into its resting position 3*a* in the first operating plane $E_a$. Upon the return of all the elements to their resting positions, the service unit 2 can leave the open-end spinning device 10 it has just serviced.

As described earlier, the bobbin 121 lies on the winding roller 120 during the movement of the yarn suction pipe 3 from its operating position 3A into its operating position 3B. Thereby any negative influence of this operational movement of the yarn suction pipe 3 upon the already formed windings $W_1$ is avoided. Therefore, the contact position of the bobbin 121 on the winding roller 120 during this operational movement of the yarn suction pipe 3 results in a defined transition from the parallel windings $W_1$ into the yarn end reserve R, because the yarn excursion executed in the direction of the end of tube 125 cannot affect the parallel windings $W_1$ beyond the nip between the bobbin 121 and the winding roller 120. However, the contact position of the bobbin 121 on the winding roller 120 is not absolutely necessary for the formation of the windings $W_1$ themselves, so that in principle it suffices if the bobbin 121 is brought into contact with the winding roller 120 only at the beginning of the above-mentioned yarn excursion for the formation of the yarn end reserve R. On the other hand, the application of the full bobbin 121 on the winding roller 120 causes the windings $W_1$ and $W_2$ to be rolled in to a certain degree due to the contact pressure of the bobbin 121 on the bobbin surface. The windings W, and W2 being rolled into the bobbin is an advantage for the retention of the yarn end on the bobbin 121. In connection with this, improved retention occurs since the bobbin body has a certain surface roughness because of the hairiness of the yarn F. In this manner, the end of the yarn F deposited here in the form of one or several windings $W_2$ is effectively secured, even during subsequent handling in the course of transportation and in further treatment in a yarn processing textile machine, e.g., a knitting or weaving machine.

In principle, it does not matter at which end of the bobbin 121 the yarn end reserve R is formed. Since in subsequent further processing of the yarn F wound up on a conical bobbin 121 the yarn is pulled off from the bobbin on the side with the smaller diameter, it is advantageous to provide the yarn end reserve R at this bobbin end.

According to the above description, the yarn suction pipe 3 executes different operational movements in a defined manner in the two operating planes $E_a$ and $E_b$. These operational movements of the yarn suction pipe 3 are controlled by a control device 6 that also interacts with a transfer device 4 (see FIG. 3) by means of which the yarn suction pipe 3 can be moved from the first operating plane $E_a$ into its second operating plane $E_b$ and back.

Figure 4:
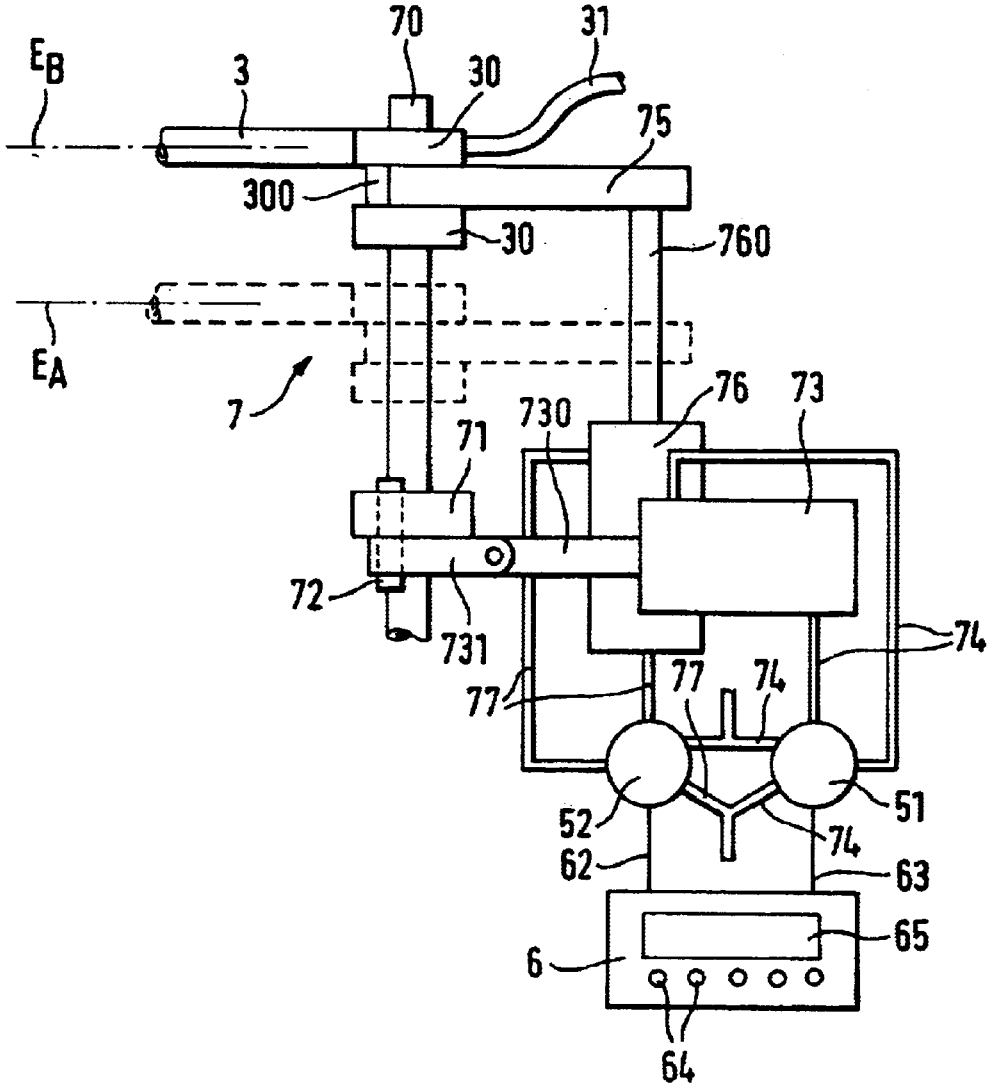
FIG. 4 shows a modified embodiment of the driving apparatus of the yarn suction pipe.

As FIG. 4 shows, the control device 6 can be programmed in a suitable manner. Adjusting knobs 64 are used to program, for example, whereby the adjustments made can be displayed on a display 65. Additionally, or alternatively, a possibility for the insertion of a data support (chip, CD Rom, etc) by means of which the control device is suitably programmed can also be provided, so that the piecing process and other tasks can be carried out in the desired manner during the different operational phases. In this case, the yarn suction pipe 3 is brought successively into the corresponding operating planes $E_a$ and $E_b$ in which it carries out the corresponding operational movements in a predetermined time sequence by following the program of the control device 6 as a function of these operational phases.

As has been described, the yarn suction pipe 3 is brought into the first operating plane $E_a$ based on the predetermined program in order to constitute a piecing reserve A. In this operating plane $E_a$, a possibly occurring yarn surplus can also be received. To constitute a yarn end reserve R, however, the control device 6, on basis of its predetermined program, causes the yarn suction pipe 3 to be brought into its second operating plane $E_b$ in which the yarn suction pipe 3 carries out the necessary operational movements.

The previously mentioned transfer device 4 (FIG. 3) has a swivel pin 40 to which the yarn suction pipe 3 is non-rotatably connected. The swivel pin 40 is connected to a swivel drive 41 which may be designed in form of a stepping motor. This swivel drive 41 of the yarn suction pipe 3 is in turn mounted on a holding device 42 which is pivotably mounted on a shaft 43. The holding device 42 is made in the form of a two-arm lever, whereby a piston rod 440 of a pneumatic or hydraulic drive cylinder 44 is connected to the free end of this lever via a coupling element 441.

The drive cylinder 44 is connected to a control valve 5 via lines 50 for the arrival or removal of the control medium. The control valve 5 controls the arrival of the control medium into or removal of the control medium out of the drive cylinder 44. No detailed drawing of the control valve 5 or of the line 50 have been provided for sake of clarity, and because such controls are sufficiently well known.

The control valve 5 as well as the swivel drive 41 is connected via control lines 61 and 60, respectively, to the above-mentioned control device 6 which controls the piecing process, the replacement of a full bobbin 121 by an empty tube 125, and other processes such as cleaning of the open-end spinning device 10 or details thereof.

Figure 3:
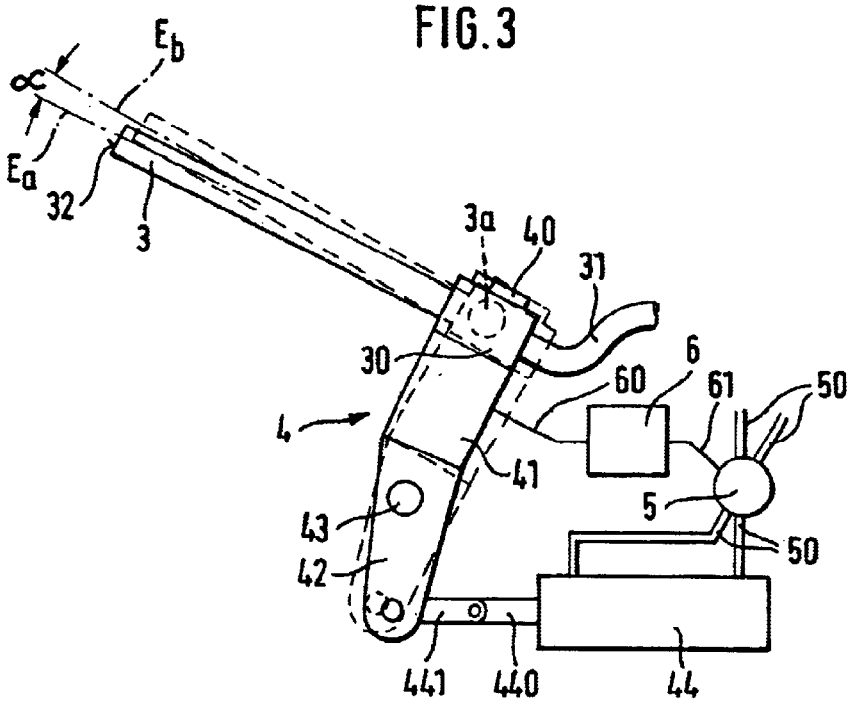
FIG. 3 shows a lateral view of a controlled yarn suction pipe according to the invention together with its drives and a control device.

As FIG. 3 clearly shows, the yarn suction pipe 3 that is presented in FIG. 3 to the bobbin 121 (not shown) is either in the operating plane $E_a$ in which the yarn suction pipe 3 takes up the yarn F presented to it as described above and in which it also temporarily stores a yarn surplus produced during the piecing process, or it is in the operating plane $E_b$ in which the yarn suction pipe 3 presents the yarn F to the bobbin 121 so that a yarn reserve R may be produced on it, depending on the swivel position of the holding device 42. To transfer the yarn suction pipe 3 from the operating plane $E_a$ into the operating plane $E_b$ or from the operating plane $E_b$ into the operating plane $E_a$, the holding device 42 is swiveled correspondingly under the control of the control device 6, the control valve 50, and the drive cylinder 44. Independent of the swivel position of the holding device 42 and therefore of the operating plane $E_a$ or operating plane $E_b$ occupied by the yarn suction pipe 3, the yarn suction pipe 3 is always swiveled around the same swivel pin 40 to be transferred into the resting position 3*a* or the operating position 3*b*, 3*c*, 3A, 3B, or 3C.

The described device as well as the described process are not limited to the embodiment mentioned, but can be modified in many ways under the present invention, in particular through the replacement of individual characteristics by equivalents as well as through different combinations of the characteristics or of their equivalents. Thus, it is not necessary for the operating planes $E_a$ and $E_b$ to include a sharp angle a as shown in FIGS. 1 and 3. Placing the two operating planes $E_a$ and $E_b$ at different angles relative to each other is perfectly possible. Thus, it is possible to bring the yarn suction pipe 3 into a third operating plane (not shown) extending, e.g., parallel to the plane of the drawing in addition to the two mentioned operating planes $E_a$ and $E_b$ in order to take over the task of the presentation device 21 in this third operating plane. In this third plane, for instance, the yarn suction pipe 3 can take up the yarn F extending from the bobbin 121 to the suction pipe 20 through suitable control of the negative pressures in the suction pipe 20 and in the yarn suction pipe 3, and convey it to the clamping device 220 of the yarn presenter 22 as well as to the yarn end preparation device 23. Upon release of the yarn F, the yarn suction pipe 3 can be returned from this (not shown) third operating plane into its previously mentioned operating plane $E_a$ to be placed in the operating position 3*b* shown in FIG. 1 where it then carries out the described tasks.

To make it possible for the yarn suction pipe 3 to carry out the different tasks and to be brought into the operating planes $E_a$ and $E_b$ provided for these tasks, it may be necessary under certain conditions that the transfer device 4 be provided with a pin in addition to the swivel pin 40 and the pin 43.

In the embodiment described above, it is also possible to transfer the yarn suction pipe 3 by means of a transfer device designed in a similar manner as those described above through FIG. 3 from one operating plane $E_a$, $E_b$ . . . into another. For reasons of space availability, it is generally advantageous with such a design of the device if the resting position 3*a* of the yarn suction pipe 3 is always in just one of the operating planes $E_a$, $E_b$ . . . provided.

As shown in FIG. 3, the pin 43 around which the holding device 42 can be swiveled is essentially parallel to the longitudinal axis of the open-end spinning machine 1 and of its shafts, such as the winding roller 120 or the draw-off shaft 110. This is especially advantageous if the yarn suction pipe 3 is also to take over the traversing of the yarn F along the bobbin 121 in addition to its storing tasks. Nevertheless, it may be advantageous under certain conditions to place the pin 43 at an angle to the longitudinal axis of the open-end spinning machine 1, e.g., to ensure, whatever the form of the bobbin 121 (conical or cylindrical) may be, that the yarn suction pipe 3 can always be brought with its outlet 32 into the closest possible proximity of the tube 125 and/or the bobbin end on which the windings $W_1$ and $W_2$ are formed.

As the embodiment of FIG. 4 shows, it is also possible to provide operating planes $E_A$ and $E_B$ for the yarn suction pipe 3 which are not at an angle a relative to each other but are parallel to each other. The yarn suction pipe 3 is for example installed non-rotatably by means of a hub 30 on a swivel pin 70 of a transfer device 7, e.g., by means of a hub-and-spring combination. The swivel pin 70 in the embodiment shown has an arm 71 extending radially to the outside, to the end of which a pin 72 and an intercalated coupling element 731 connects the piston rod 730 of a drive cylinder 73. The control medium is conveyed to the drive cylinder 73 or is removed from it by means of lines 74. These lines 74 are controlled suitably by means of a control valve 51 that is connected via a control line 63 to the control device 6.

The hub 30 by means of which the yarn suction pipe 3 is mounted on the swivel pin 70 furthermore contains a connection bore (not shown) connected to the yarn suction pipe 3, and through it a hose 31 or a mobile or mounted pipe is connected to the negative-pressure source (not shown) to establish the connection between the yarn suction pipe 3 and the negative-pressure source. On its outer circumference, the hub 30 is provided with a circumferential groove 300 into which a fork-shaped lifting element 75 enters. The end of this lifting element 75 away from the hub 30 is supported by the free end of a piston rod 760 of a drive cylinder 76 that is connected via lines 77 to the control valve 52, the latter being in turn connected via a control line 62 to the control device 60 for control.

With the described transfer device 7, the yarn suction pipe 3 is moved by means of the suitably controlled drive cylinder 76 along its swivel axis 70 into the desired operating plane $E_A$ or $E_B$, while the yarn suction pipe 3 is placed in its currently required swivel position by means of a suitably controlled drive cylinder 73.

The yarn suction pipe 3 can also be shifted between its operating planes $E_a$, $E_b$, . . . or $E_A$, $E_B$ . . . by means of transfer devices that are designed differently from the shown embodiments (transfer device 4 or 7). It is, for example, also possible to mount the yarn suction pipe 3 in a connecting link (not shown) so that it can be shifted, whereby the connecting link may also follow an irregular course, depending on the tasks to be carried out by the yarn suction pipe 3. Such a connecting link can be provided for the transfer from one operating plane into another operating plane, as well as for the movement of the yarn suction pipe 3 within one operating plane. The transfer operations described above apply similarly to the use of a curved path on which a guiding element of the yarn suction pipe 3 and/or of the transfer device 4 or 7 is pressed by means of an elastic or similar element.

According to the embodiments described above the yarn F that is presented to the yarn suction pipe 3 is taken from the bobbin 121 that is in the winding device 12. The operational steps required to present the yarn F to the yarn suction pipe 3 can however deviate from the operational steps provided for this and described above.

It is not an absolute necessity for the described process or for the device used for it that the yarn F to be taken up by the yarn suction pipe 3 is taken from bobbin 121 on the machine. The traveling service unit 2, for example, can also carry a bobbin (not shown) from which the yarn F required for piecing can be drawn. On the occasion of a bobbin replacement, this yarn F is then presented to the yarn suction pipe 3 in connection with these operational steps.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. A traveling service unit for servicing a plurality of open-end spinning devices which comprise an open-end spinning machine, said traveling service unit comprising:

a yarn suction pipe movably mounted onto said service unit, said yarn suction pipe aiding in the servicing of the open-end spinning device and is operable within a predetermined operating plane moving back and forth from a resting position into an operating position within said operating plane for the reception of a yarn formed by one of the open-end spinning devices for servicing of said yarn;

wherein said yarn suction pipe operates within at least one additional operating plane in which said yarn suction pipe is positionable in an additional operating position, said yarn suction pipe being movable between said operating planes and between said resting position, said operating positions, and said additional operating position within said operating planes; and a control device operably disposed to said yarn suction pipe, said control device controlling the movements of said yarn suction pipe within said operating planes.

2. A servicing unit as in claim 1, wherein at least two operating planes of said yarn suction pipe form a non-zero angle between them.

3. A servicing unit as in claim 2, wherein said resting position of said yarn suction pipe is provided in proximity of an interface between said two operating planes of said suction pipe.

4. A servicing unit as in claim 2, wherein an operating position of said yarn suction pipe within a first operating plane is defined by holding a yarn end within a traversing range of a yarn traversing guide of said open-end spinning device, while said yarn end is held outside of said traversing range of said traversing guide for operating positions within additional operating planes.

5. A servicing unit as in claim 4, wherein said control device is programmable to bring said yarn suction pipe into a predetermined operating plane as a function of predetermined operating phases to carry out differently defined operational movements within said operating plane.

6. A servicing unit as in claim 5, wherein said control device is programmable to allow said yarn suction pipe to move within said first operating plane to take up a yarn surplus that becomes a piecing reserve.

7. A servicing unit as in claim 5, wherein said control device is programmable to allow said yarn suction pipe to move within said first operating plane to take up a yarn surplus so that within another operating plane said surplus becomes a yarn end reserve on a full bobbin on an open-end spinning device.

8. A servicing unit as in claim 1, wherein said resting position of said yarn suction pipe is provided within an operating plane of said yarn suction pipe.

9. A servicing unit as in claim 1, wherein said yarn suction pipe is movable into more than one operating position within at least one of its operating planes.

10. A servicing unit as in claim 1, wherein said yarn suction pipe is mounted on a first swivel pin for mobility of said yarn suction pipe.

11. A servicing unit as in claim 10, wherein said yarn suction pipe is transversally movable along said swivel pin.

12. A servicing unit as in claim 10, wherein said first swivel pin of said yarn suction pipe is mounted on a second swivel pin to further increase the mobility of said yarn suction pipe.

13. A servicing unit as in claim 12, wherein said second swivel pin is essentially parallel to the axis of a winding roller of said open-end spinning device.

14. A process for the temporary reception of a yarn from an open-end spinning device, a plurality of which constitutes an open-end spinning machine, the process comprising of the steps:

determining an operating phase to be performed on the yarn of the open-end spinning device by a traveling service unit;

moving a yarn suction pipe mounted on the traveling service unit into different operating planes as a function of the operating phase to be performed;

imparting defined operational movements to the yarn suction pipe to place the yarn suction pipe in proper operating positions within the operating planes to insure the proper performance of the operating phase; and returning the yarn suction pipe to a resting position after all operating phases requiring the use of the yarn suction pipe are performed.

15. A process as in claim 14, wherein the yarn suction pipe is movable into the same operating plane to receive a yarn drawn from a bobbin on the open-end spinning device independent of any operating planes to be occupied for execution of certain operational movements to perform the operating phase.

16. A process as in claim 15, wherein the yarn suction pipe performs operational movements within the operating plane in which the yarn suction pipe receives the yarn drawn from the bobbin to form a piecing reserve.

17. A process as in claim 16, wherein the yarn suction pipe performs operational movements within the operating plane in which the yarn suction pipe receives the yarn drawn from the bobbin to take up the yarn surplus produced during piecing.

18. A process as in claim 15, wherein the yarn suction pipe is transferred from the operating plane in which the yarn suction pipe receives the yarn drawn from the bobbin to a different operating plane to conduct operational movements to form a yarn end reserve on a full bobbin.

19. A process as in claim 18, further comprising presenting a yarn from a full bobbin to the yarn suction pipe located in a first operating plane;

rotating the bobbin in an unwinding direction, wherein the yarn suction pipe takes up the released yarn;

moving the yarn suction pipe into a second operating plane in front of the bobbin, once the bobbin is stopped;

applying the bobbin to a winding roller of the open-end spinning device to drive the bobbin in the wind-up direction causing the yarn from the yarn suction pipe to wind onto the bobbin for several parallel windings in a specified location on the bobbin depending on the location of the yarn suction pipe;

moving said yarn suction pipe to an end of the bobbin where no yarn is wound to allow several windings to accumulate on the end;

returning the yarn suction pipe to the part of the bobbin containing the yarn to form several more windings;

lifting the bobbin from the winding roller of the open-end spinning device to stop the bobbin;

cutting the yarn extending from the bobbin to the yarn suction pipe; and returning the yarn suction pipe back to the starting position within the first operating plane.

* * * * *